United States Patent [19]

Sewell-Wood

[11] 4,222,125

[45] Sep. 16, 1980

[54] SURFACE ORNAMENTED CAP

[75] Inventor: Tom Sewell-Wood, Louisville, Ky.

[73] Assignee: Louisville Manufacturing Co., Inc., Louisville, Ky.

[21] Appl. No.: 34,010

[22] Filed: Apr. 27, 1979

[51] Int. Cl.[2] ..... A42B 1/04

[52] U.S. Cl. ..... 2/195; 2/199; 2/192; 2/243 B; 112/263.1

[58] Field of Search ..... 2/192, 194, 195, 196, 2/197, 198, 199, 200, 243 B, 243 A, 243 R, 244, 275; 112/263.1, 401, 426

[56] References Cited

U.S. PATENT DOCUMENTS

| | | | |
|---|---|---|---|
| 1,594,503 | 8/1926 | Fendelman | 2/195 X |
| 2,636,181 | 4/1953 | Becker | 2/243 B |

FOREIGN PATENT DOCUMENTS

| | | | |
|---|---|---|---|
| 1460834 | 10/1966 | France | 2/192 |
| 343088 | 9/1936 | Italy | 2/192 |

*Primary Examiner*—Peter P. Nerbun

*Attorney, Agent, or Firm*—Wenderoth, Lind & Ponack

[57] ABSTRACT

A method of making a cap and a cap made thereby. A plurality of panels each having an upwardly extending tapered portion are assembled into a cap with hems along the tapered edges of each panel sewn to the hems of adjacent panels to form the crown of the cap. The tapered portions of the panels are surface ornamented prior to assembly with a decoration having directionally oriented portions which cross the seam of the cap at a crossing angle other than perpendicular to the seams. The directionally oriented portions are extended across the hems to the tapered edges of said panel at an angle perpendicular to the tapered edges. When the panels are assembled into the crown of the cap, the extended directionally oriented portions on the hem of one panel are placed against corresponding extended directionally oriented portions on the hem of the adjacent panel before sewing the hems to each other, so that the directionally oriented portions on the panel one one side of a seam will be in exact register with the directionally oriented portions on the panel on the other side of the seam. The directionally oriented portions of the surface ornamentation can be extended along the top surface of the visor of the cap.

6 Claims, 13 Drawing Figures

SURFACE ORNAMENTED CAP

This invention relates to a cap, and more particularly to a cap formed of a plurality of panels sewn together, and having surface ornamentation with directionally oriented portions which cross the seams joining the panels of the cap.

BACKGROUND OF THE INVENTION AND PRIOR ART

Caps which are formed from a plurality of panels sewn together, and which frequently have visors, are well-known, and have long been produced in various forms and shapes. These caps are usually made of a plurality of panels, having upper portions which are tapered upwardly, and which, when sewn together, form a crown for the hat, on the top of which is placed a button or the like to close the small opening where the apexes of the panels come together at the top of the crown.

It has long been the practice to ornament such caps by placing ornamentation on the respective panels prior to their being sewn together into the cap. However, ornamentation applied by printing or the like must usually be such that it is complete for the respective individual panels, i.e. such that the ornamentation does not overlap the seams between the respective panels. This is particularly true for ornamentation having directionally oriented portions such as stripes. If the preapplied ornamentation overlaps the seams between the panels, problems of registration of the portions of the ornamentation on the opposite sides of the seam arise.

Heretofore, ornamentation which extends across the seams of such a cap has been applied in the form of a separate piece of material, such as an embroidered patch or the like along the lower front portion of the panels just above the visor.

As can be understood, this problem of registration of directionally oriented ornamentation on the different panels of such caps limits rather sharply the different types of ornamentation which can be applied to such caps.

It would be desirable, in order to increase the variety of types of ornamentation which can be applied to such caps, to provide a method for ornamenting such caps with ornamentation which has directionally oriented portions crossing the seams of such caps with good registration, and more particularly which has such directionally oriented portions crossing the seams of the cap at angles other than perpendicular to the seams.

OBJECTS AND BRIEF SUMMARY OF THE INVENTION

It is accordingly an object of the present invention to provide a method of surface ornamenting a cap formed from a plurality of panels sewn together along seams, which surface ornamentation has directionally oriented portions which cross the seams of the cap at a crossing angle other than perpendicular to the seams and with good registration on opposite sides of the seams.

It is a further object of the invention to provide such a method by which it is possible to bring the portions of a directionally oriented ornamental portion on opposite sides of a seam on such a cap into exact registration while assembling the cap.

It is a still further object of the invention to provide a method for extending such a directionally oriented portion of a surface ornamentation from the crown of the cap onto the visor.

Another object is to provide a cap made by such a method.

The objects are achieved, according to the present invention, by carrying out particular surface ornamenting steps during the making of a cap which includes forming a plurality of panels each having a base portion and an upwardly extending tapered portion defined by opposite upper inwardly curved edges, and assembling the panel into a cap including turning the upwardly tapered edges of each panel inwardly of the cap in a hem and sewing the hems of adjacent panels together along the junctions of the panels and the hems in seams to form the crown of the cap. The cap is surface ornamented by ornamenting the tapered portions of at least some of the panels prior to assembly with a decoration having directionally oriented portions which cross the seams of the cap at a crossing angle other than perpendicular to the seams. The directionally oriented portions on each ornamented panel are extended up to the junctions of the hems and the remainder of the panel at the crossing angle, and then are further extended across the hems across said junctions to the tapered edges of the panel at an angle perpendicular to the tapered edges. When assembling the panels into the crown of the cap, the further extended directionally oriented portions on the hem of one panel are placed against the corresponding further extended directionally oriented portions on the hem of the adjacent panel before sewing the hems in the seam, whereby the directionally oriented portions on the panel on one side of the seam will be in exact register with the directionally oriented portions on the panel on the other side of the seam.

Other and further objects and advantages of the invention will become apparent from the following specification, taken together with the accompanying drawings, in which:

DETAILED DESCRIPTION OF THE INVENTION

Figure 1:
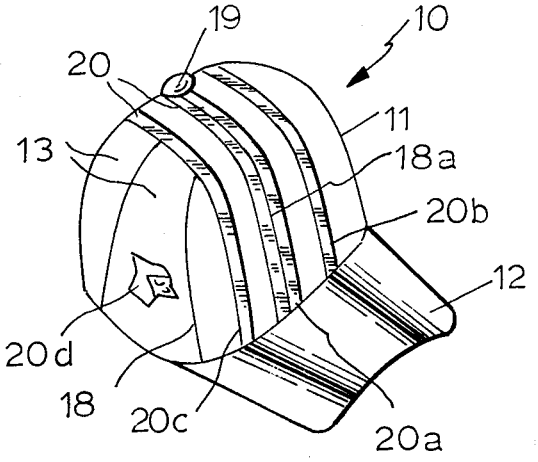
FIG. 1 is a perspective view of a visored cap with one example of a surface ornamentation according to the present invention.
Figure 3:
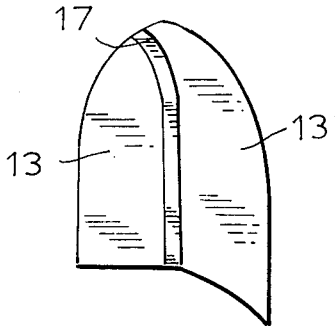
FIG. 3 is a perspective view, from the inside, of two of the panels sewn to each other.
Figure 4:
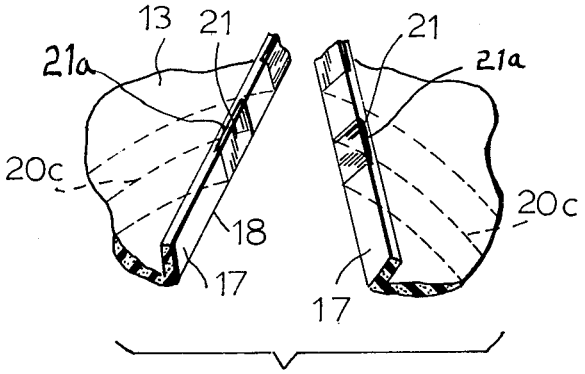
FIG. 4 is a partial perspective view, on an enlarged scale, and viewed from the inside of the cap, of two hem portions of adjacent panels opposed to each other prior to being sewn together.
Figure 5:
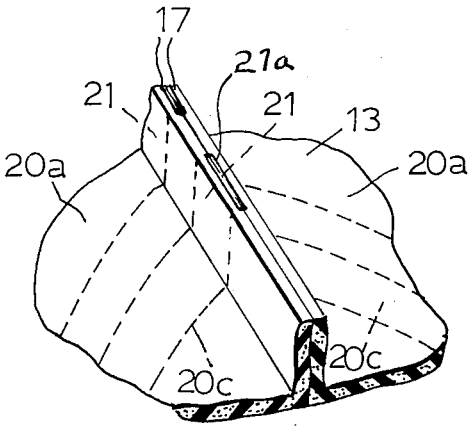
FIG. 5, is a partial view of the hem and panel portions of FIG. 4, with the hem portions sewn together.

Referring first to FIGS. 1–5, the cap 10 is, like conventional caps, formed of a crown 11 and optionally has a visor 12, and the crown is assembled from a plurality of panels 13 each having a base portion 14 with a horizontal base edge 14*a* and lower vertical edges 14*b*, and a tapered portion 15 having upwardly and inwardly curving edges 15*a*. Along the edges of at least the tapered portions 15 of the panels are hems 17 which, during assembly of the cap, are turned inwardly around a junction line, and a seam 17 is sewn from the inside of the cap along the junction line with the surfaces of the inwardly turned hems abutting each other, as shown in FIGS. 3 and 5. There thus appears on the exterior of the crown of the cap seams 18 which extend from the lower edge upwardly over the crown to the top, and the top is provided with a top closure means 19, usually in the form of a button or the like.

The cap can also be, and is usually, provided with a visor 12, which will be discussed more fully hereinafter. It is also usually provided with a headband around the interior of the lower edge of the crown, and an opening with an adjustable stap at the back of the lower portion of the crown. These parts are conventional and are not shown.

The surface ornamentation 20 which is applied according to the present invention has at least some directionally oriented portions which cross the seams 18 of the cap at angles other than perpendicular to the seams. This particular surface ornamentation shown in the drawings of the present application is constituted by parallel stripes 20*a*–20*c* extending from the lower edge of the front of the crown 11 up over the top of the crown and down the back of the crown, simulating stripes which are commonly painted on helmets such as football helmets. A surface ornamentation such as the representation shown at 20*d* can also be applied to one of the panels 13 on the side of the cap to further simulate the appearance of a football helmet. In this embodiment, such ornamentation is applied conventionally since it lies entirely within the boundaries of the panel, and the manner of applying it forms no part of the present invention. However, is should be understood that should it be positioned such that it overlaps a seam or be large enough to cross a seam, it should be treated in the same manner as the stripes, as described hereinafter.

The stripes forming the surface ornamentation of the particular embodiment which is disclosed include a center stripe 20*a* which straddles the center front and the center rear seams 18*a* of the cap, and a left side stripe 20*b* and a right side stripe 20*c*. In the particular embodiment shown, it is preferred that the side stripes 20*b* and 20*c* be a different color than the center stripe 20*a*, although this is not essential. The stripes, of course, should be of a color which contrasts with the color of the panels themselves.

Figure 2A:
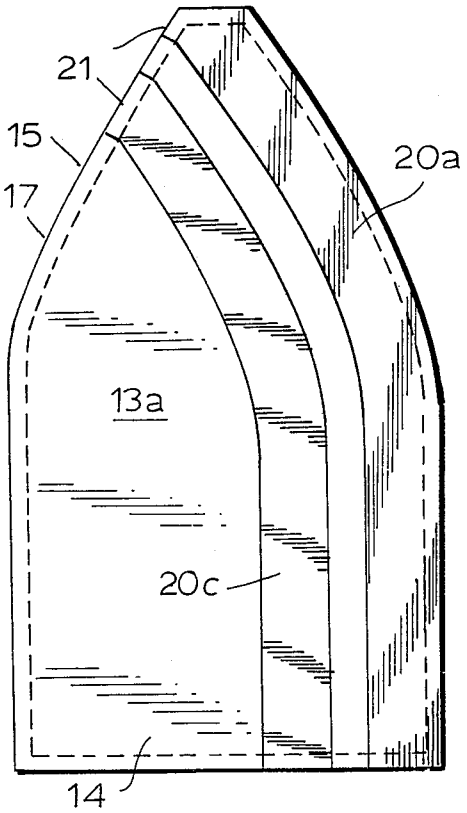
FIG. 2*a*–2*c* are plan views of panels for assembly into the cap of FIG. 1.
Figure 2B:
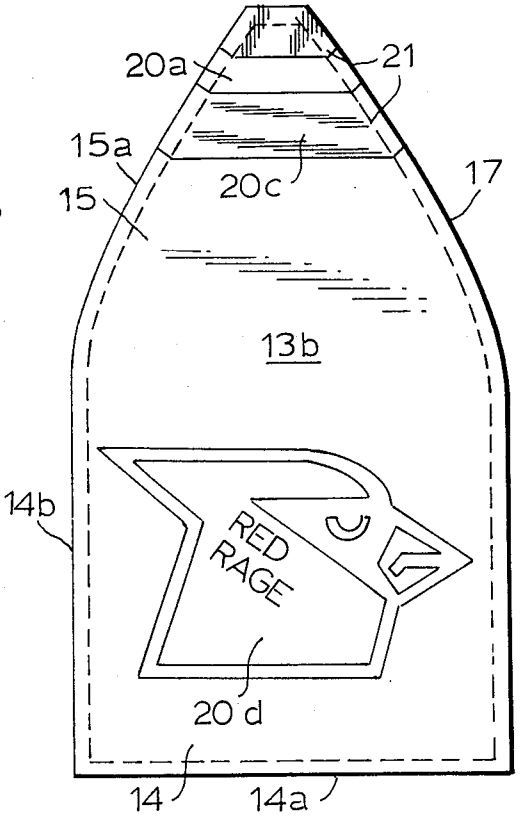
Figure 2C:
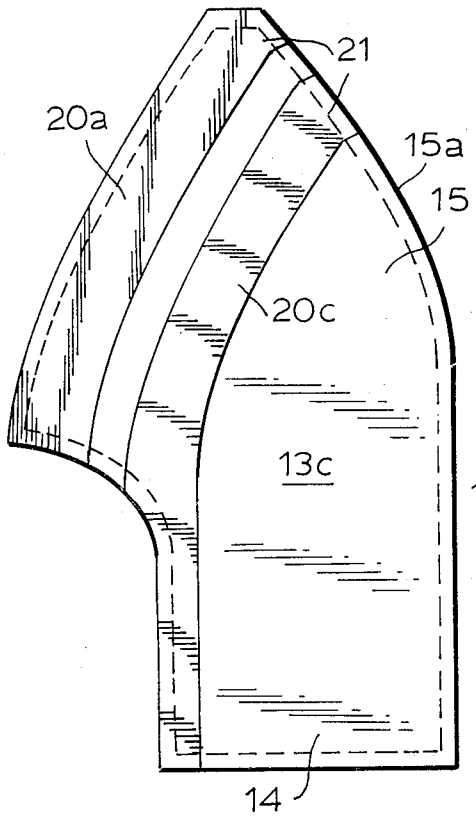

As can be seen from the panels 13*a*–13*c* shown in FIGS. 2*a*, 2*b* and 2*c*, and which, when sewn together, constitute the right half of the crown 11 of the hat, the center stripe 20*a* and the right side stripe 20*c*, when they reach the lefthand upper inwardly curved edge 15*a* of the panel 13*a*, approach the edge at an angle other than perpendicular to the edge. Likewise, the portions of these stripes 20*a* and 20*c*, where they cross the tapered portion 15 of the panel 13*b* in FIG. 2*b*, also are at an angle other than perpendicular to the edges 15*a*. Finally, where the stripes 20*a* and 20*c* reach the edge 15*a* of the tapered portion 15 of the panel 13*c* shown in FIG. 2*c*, the stripes are also at an angle other than perpendicular to the edge 15*a*. Thus they must, in order to be properly directionally oriented on the finished cap, cross the seams at an angle other than perpendicular to the seams.

In order that the portions of the stripes on the respective panels on the opposite sides of the seams be brought into exact register when the panels 13 are sewn together into the crown 11 of the cap, the stripes are extended across the hems from the line corresponding to the junction of the hems 17 with the remainder of the panel, and which eventually becomes the seam line 18, at an angle perpendicular to the edges 15*a*, as shown at 21.

When the panels 13 are assembled into the crown 11 of the cap by the person carrying out the assembly turning the hems 17 inwardly, with respect to the finished cap, the portions 21, as shown in FIG. 5 can be placed in register with each other, and thereafter the seam 18 is sewn. It should, however, be understood that the person carrying out the assembly is working on what is really the inside of the cap, and at this point in operation has the partially assembled cap turned inside out with the hems turned outwardly. At the end of this operation, the portion of the stripes 20*a* and 20*c* on what eventually becomes the outside surface of the panels on the opposite sides of the seam 18 are in exact register.

By extending the directionally oriented portions of the surface ornamentation, mainly the ends of the stripes 20, across the hems 17 perpendicular to the edges of the panels 13, there has been provided a means by which the person assembling the hat can easily bring these directionally oriented portions into exact register on the exterior surface of the cap, even though at this point in the assembly operation the hems are turned outwardly toward the outwardly facing interior surface of the cap to be sewn together to assemble the panels into the crown of the cap, and the outer surface of the cap, now facing inwardly of the partly assembled cap, is not visible. Without such an extension of the directionally oriented portions of the surface ornamentation, the person assembling the cap would have no way of being sure that the directionally oriented portions were properly registered. It would of course be possible to first bring the hems together while looking at the ornamented surface of the panels, to bring the directionally oriented portions of the surface ornamentation into register, and then turn the panels over so as to be able to sew along the inside of the crown. However, while this might work for two panels, or possibly even three, by the time the fourth, fifth and sixth panels are assembled, it is not possible to do this, since the cap must be turned inside out to sew along the hems to form the seams. Moreover, turning the cap over each time a panel was sewn would not only be unduly time consuming, and therefore greatly increase the cost of assembling the cap, but there is a danger that the hems would slip along each other at the time the cap was turned to gain access to the inwardly turned hems for sewing, thus moving the directionally oriented portions of the surface ornamentation out of register.

The provision of the portions 21 eliminates all of these drawbacks and makes it easy for the person assembling the cap to accurately register the directionally oriented portions of the surface ornamentation without ever looking at the ornamented surface of the panels which are on the exterior of the finished cap. The assembly operation is therefore greatly simplified and speeded up, thereby keeping the cost of the assembly operation to a minimum.

Figure 6:
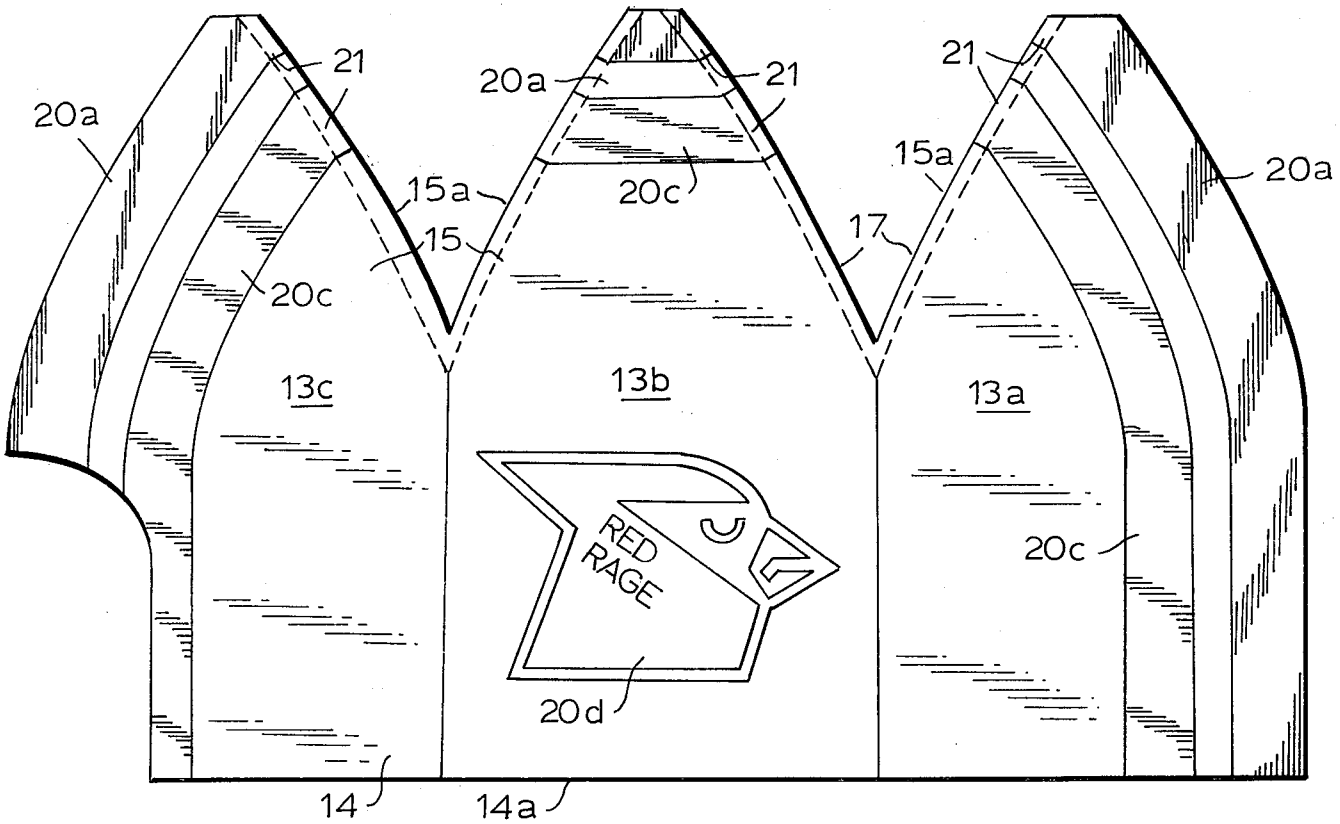
FIG. 6 is a plan view of a modified form of the panels of FIGS. 2*a*–2*c;*

The panels 13 for assembly into the cap are shown in FIGS. 2*a*–2*c* as being separate panels. It has been found that the assembly of the panels into the cap can be speeded if the panels are joined to each other along the lower vertical edge portions of the base portions of the respective panels, as shown in FIG. 6. FIG. 6 shows only the three panels 13*a*–13*c* of FIGS. 2*a*–2*c*. It should be understood that three additional panels which together constitute the left side of the crown are joined to the right edge of the panel 13*a* so that all six panels 13 which together consititute the crown portion of the cap are cut from a single piece of material and are initially joined along the lower vertical edges. The manner of extending the directionally oriented portions of the surface ornamentation is identical with the manner of extending these portions as shown in FIGS. 1–5, and the description will not be repeated here.

Figure 7A:
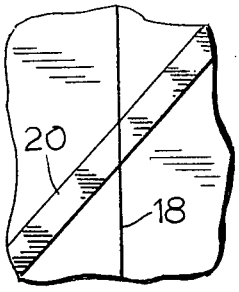
FIGS. 7*a* and 7*b* are fragmentary plan views of a layout for forming a pattern for transferring the ornamentation onto the panels of the cap.
Figure 7B:
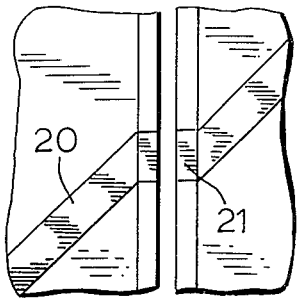

There are a number of ways to prepare the pattern for forming the surface ornamentation on the panels. Since the surface ornamentation is transferred to the panels by any one of a number of conventional processes, such as screen printing, multilithograph printing, sublimation of decorating material from a substrate to the panels, and the like, a pattern for use in such a transfer process must be prepared. One way of preparing such a pattern is shown in FIGS. 7*a* and 7*b*. In this method, a layout of the surface ornamentation for the various panels is prepared in which the seam lines 18 are indicated. The layout is then separated along the seam lines, and the directionally oriented portions 20 of the pattern are extended from the seam lines a distance equal to the width of the hem, as at 21. This may involve providing additional material to simulate the hem. These portions 21 are extended perpendicular to the line corresponding to the edge of the panel at this point in the pattern. From this layout, a pattern is prepared for use in the desired transfer process. For example, if a screen printing process is to be used, a screen is prepared in which the portions 20 and 21 appear as apertures, and the undecorated portion of the panel is solid. This pattern is then used in the desired transfer process to transfer the decorative material, such as printing ink or the like, to the panels to form the ornamentation as shown in FIGS. 2*a*–2*c* or FIG. 6.

Figure 8A:
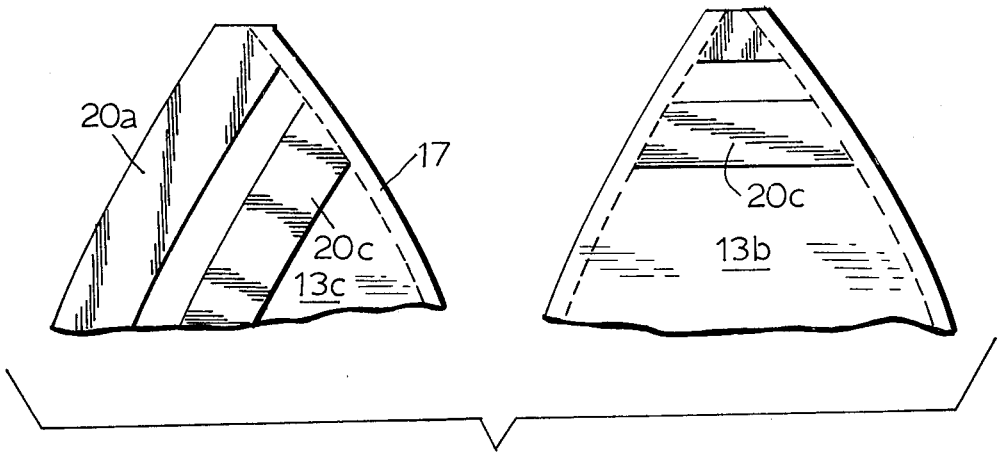
FIGS. 8*a* and 8*b* are enlarged fragmentary view of portions of panels showing another method of forming a pattern for transferring the ornamentation onto the panels of the cap.
Figure 8B:
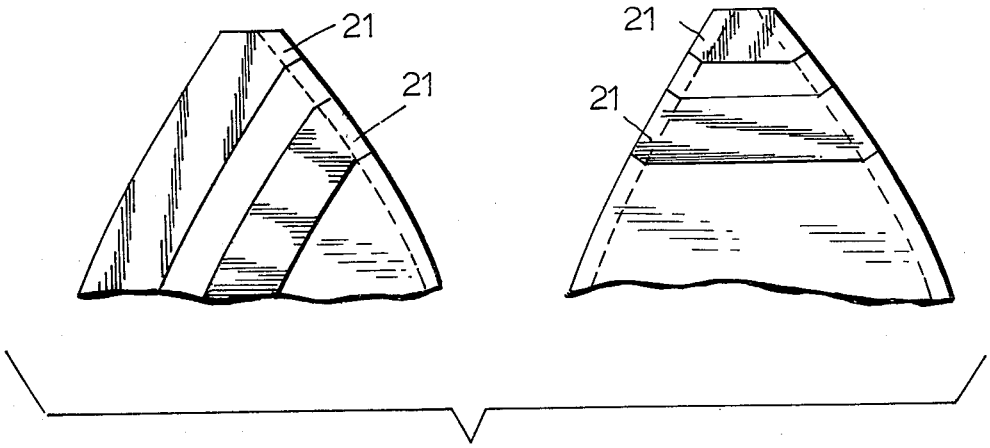

An alternative process is to first assemble blank panels 13 into an undecorated crown, and then place the desired surface ornamentation on the thus formed crown, for example by hand. The surface ornamented panels are then separated, in which case they will appear as shown in FIG. 8*a*, which is representative of panels from a blank crown on which a pattern like that of FIGS. 1–6 has been placed. It will be seen that the stripes 20*a* and 20*c* extend only to the junction of the hem with the remainder of the panel. The stripes do not extend across the hem since in the sewnup crown of blank panels, these hems will not be exposed to the exterior of the crown. The decorative material will therefore, not reach the surfaces of the hems. After the panels have been disassembled, the directionally oriented portions of the surface ornamentation are extended across the hems as shown in 21 in FIG. 8*b*. Using the thus modified panels, a pattern is prepared for the desired transfer process, and the pattern is used in ornamenting the panels for assembly into the final cap as shown in FIGS. 2*a*–2*c* and FIG. 6.

In actual practice in most cases, regardless of what type of transfer process is used, the decorative material such as ink, penetrates the material of the panels slightly, and the end of the directionally oriented portion 21 crossing the hem is visible at the edge of the material of the hem as shown at 21*a*. This facilitates assembly, since the worker assembling the cap can simply align these edge-visible portions 21*a* rather than having to look at the opposed faces of the hems to align portions 21.

Figure 9:
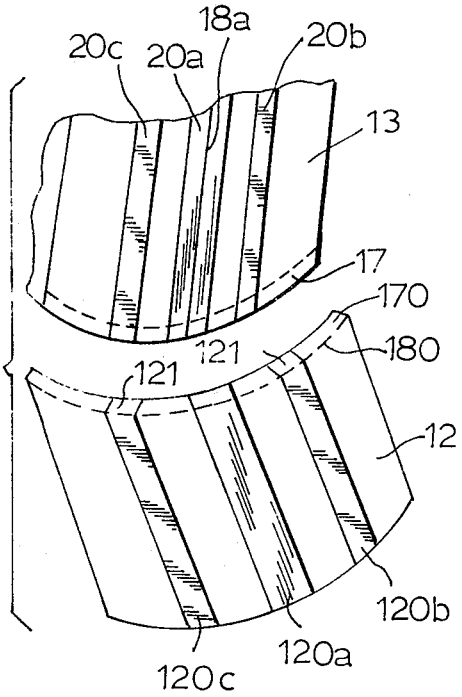
FIG. 9 is a fragmentary exploded view of a portion of a crown of a cap and a visor with surface ornamentation according to the present invention.

The surface ornamentation on the cap can be extended onto the upper surface of the visor 12 in the manner as shown in FIG. 9.

The normal manner of attaching the visor to the crown of the cap is by placing a hem 170 which extends along the concavely curved base edge 180 of the visor against the hems 17 along the lower edges 14 of the panels 13 for forming the front portion of the cap, and sewing the hems together along a seam corresponding to the concavely curved base edge 180.

In order to extend the directionally oriented portions of the surface ornamentation 20 on the crown of the cap onto the upper surface of the visor, the upper surface of the visor is first provided with directionally oriented surface ornamentation, here shown in the form of stripes 120*a*, 120*b* and 120*c*, which are extended to be continuations of the corresponding stripes 20*a*, 20*b* and 20*c* on the crown portion of the cap, and which have colors respectively corresponding to these stripes. The stripes are positioned on the cap in this particular embodiment to extend from the rear of the visor to the front, generally parallel to the sides of the visor.

However, as with the panels, when the hems of the visor and the lower edges of the panels are turned inwardly in order to sew the seam between the visor and the crown, the directionally oriented surface ornamentation portions cannot be seen, since the person assembling the visor to the crown of the cap is working from the inside of the visor.

Accordingly, the directionally oriented portions which cross the visor seam between the base portions of the panels 13 and the visor 12 at an angle other than perpendicular to a tangent to the visor seam, must first be extended along the upper surface of the visor up to the position of the seam, i.e. the line 180 and then those portions which cross the seam at an angle other than perpendicular to a tangent to the curved line 180, in this embodiment the stripes 120*b* and 120*c*, must be further extended across the hem 170 at an angle perpendicular to the curved line 180. Thus, when the faces of the hems 17 and 170 are placed against each other, the portions 121 which extend across the hems 17 and 170 are placed in register with the ends of the stripes 20*a*–20*c* on the hems 17 at the lower edges of the panels 13 on the front of the crown, and then the seam is sewn along the junction of the hem and the remainder of the panels 13 and the visor 12. In this manner, the directionally oriented portions 120*b* and 120*c* are in exact register with the directionally oriented portions 20*b* and 20*c* on the crown portion of the cap.

It will be noted that since the directionally oriented portion 120*a*, in this instance a stripe, crosses the hem 170 substantially perpendicularly to the tangent to the line 180, it is not necessary to change the direction of this portion. It is simply continued in the same direction as the portion 120*a* extends along the visor 12.

It will thus be seen that there has been provided a method of providing surface ornamentation on a cap and a surface ornamented cap formed by the method. The cap has a plurality of panels, and also the visor with the directionally oriented portions of the surface ornamentation which cross the seams of the panels and cross the seam between the crown and the visor at an angle other than perpendicular to the seam in exact register on the opposite sides of the seams. The assembly can be carried out without the necessity of the person assembling the cap having to be able to see the directionally oriented portions of the surface ornamentation on the outside of the cap and visor, thereby making it possible to work from the inside of the cap, and is conventional in assembling the cap, so that the seams on the outside of the cap are neat and clean.

It will of course be understood that while the specific form of surface ornamentation shown in the present application consists of stripes extending from the front of the cap up across the top of the crown and down the rear of the cap, and also extending from the front of the crown to the front of the visor, the same method can be used to provide a cap with other types of surface ornamentation which have directionally oriented portions crossing the seams at angles other than perpendicular to the seams. The critical aspect of the method is in extending the directionally oriented portions of the surface ornamentation across the hems in a direction perpendicular to the edge of the hem or panel, so that when the hem is folded inwardly of the cap, the extension of the directionally oriented portion can be placed against the corresponding extension of the directionally oriented portion of the hem of the next adjacent panel so as to bring the directionally oriented portions on opposite sides of the seam into exact register.

What is claimed is:

1. In a method of making a cap by forming a plurality of panels each having a base portion and an upwardly extending tapered portion defined by opposite upper inwardly curved edges, and assembling the panels into a cap including turning the upwardly tapered edges of each panel inwardly of the cap in a hem and sewing the hems of adjacent panels together along the junction of the panel and the hems in seams to form the crown of the cap, a method of providing surface ornamentation on the cap comprising: surface ornamenting the tapered portions of at least some of the panels prior to assembly with a decoration having directionally oriented portions which cross the seams of the cap at a crossing angle other than perpendicular to the seams; extending the said directionally oriented portions on each ornamented panel up to the junctions of the hems and the remainder of said panel at the crossing angle of said directionally oriented portions; further extending said directionally oriented portions across said hems from said junction to the tapered edges of said panel at an angle perpendicular to said tapered edges; and, when assembling said panels into the crown of the cap, placing the said further extended directionally oriented portions on the hem of one panel against corresponding further extended directionally oriented portions on the hem of the adjacent panel before sewing the hems in the seams, whereby the directionally oriented portions on the panel on one side of a seam will be in exact register with the directionally oriented portions on the panel on the other side seam.

2. The method as claimed in claim 1 in which said steps of surface ornamenting and extending comprise: preparing a layout of the surface ornamentation for the panels which are to be surface ornamented with the location of the seam lines indicated; separating the layout along the seam lines; extending the directionally oriented portions from the seam lines a distance equal to the width of the hem; preparing a pattern from the thus modified layout for transferring the layout of the surface ornamentation; and transferring the surface ornamentation onto the panels by the use of the thus prepared pattern.

3. The method as claimed in claim 1 in which said steps of surface ornamenting and extending comprise: sewing blank panels into the crown of a cap with seams along hems on the edges of the panels; placing the surface ornamentation on the thus formed crown; separating the surface ornamented panels; extending the directionally oriented portions from the seam lines of each panel across the hems to the edges of the hems; preparing a pattern from the thus modified panels for transferring the surface ornamentation of the panels; and transferring the surface ornamentation on the panels by the use of the thus prepared pattern.

4. The method as claimed in claim 1 in which making the cap further includes assembling the base of a visor having a concavely curved base edge with a hem therealong to hems on the lower edges of the base portions of the panels forming the front portion of the cap along a visor seam parallel to said curved base edge, the directionally oriented portions on said panels being extended across said base portion hems perpendicular to the edge thereof, and in which the step of providing surface ornamentation on the cap further comprises: surface ornamenting the visor prior to assembly into the cap with a decoration having directionally oriented portions which cross the visor seam between the base portions of the panels and said visor at an angle other than perpendicular to a tangent to said visor seam; extending the said directionally oriented portions on the visor up to the junction of the visor and the hem along said base edge at the crossing angle of said directionally oriented portions; further extending said directionally oriented portions across the visor hem from said junction to the edge of the hem at an angle perpendicular to the curved base edge; and, when assembling said visor to said panels, placing the said further extended directionally oriented portions on the hem of the visor against the corresponding directionally oriented portions on the hem of the adjacent panel before sewing the hems on the visor seam.

5. A surface ornamented cap comprising a plurality of panels each having a base portion and an upwardly extending tapered portion defined by opposite upper inwardly curved edges, the upwardly tapered edges of each panel being turned inwardly of the cap in a hem and sewn to the hems of adjacent panels along the junction of the panels and the hems in seams to form the crown of the cap, surface ornamentation on the tapered portions of at least some of the panels, said surface ornamentation having been provided prior to assembly and having directionally oriented portions which cross the seams of the cap at a crossing angle other than perpendicular to the seams, said directionally oriented portions on each ornamented panel extending up to the junctions of the hems and the remainder of said panel at the crossing angle of said directionally oriented portions and further extending across said hems from said junction to the tapered edges of said panel at an angle perpendicular to said tapered edges.

6. The cap as claimed in claim 5 in which the cap further includes a visor having a concavely curved base edge with a hem therealong sewn to hems on the lower edges of the base portions of the panels forming the front portion of the cap along a visor seam parallel to said curved base edge, the directionally oriented portions on said panels extending across said base portion hems perpendicular to the edge thereof, surface ornamentation on the visor having directionally oriented portions which cross the visor seam between the base portions of the panels and said visor at an angle other than perpendicular to a tangent to said visor seam and extending on the visor up to the junction of the visor and the hem along said base edge at the crossing angle of said directionally oriented portions and further extending across the visor hem from said junction to the edge of the hem at an angle perpendicular to the curved base edge.

* * * * *